US008113646B2

(12) United States Patent
Elrod et al.

(10) Patent No.: US 8,113,646 B2
(45) Date of Patent: Feb. 14, 2012

(54) COMBINED INKJET AND PHOTOCHROMIC REUSABLE PAPER PERSONAL PRINTER

(75) Inventors: Scott A. Elrod, La Honda, CA (US); Gerald A. Domoto, Briarcliff Manor, NY (US); Eric J. Shrader, Belmont, CA (US); Gabriel Iftime, Mississauga (CA)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 461 days.

(21) Appl. No.: 12/400,148

(22) Filed: Mar. 9, 2009

(65) Prior Publication Data

US 2010/0225722 A1 Sep. 9, 2010

(51) Int. Cl.
*B41J 2/01* (2006.01)
*B41J 29/38* (2006.01)
*B41J 3/00* (2006.01)

(52) U.S. Cl. ..... 347/104; 347/16; 347/2

(58) Field of Classification Search ..... None
See application file for complete search history.

(56) References Cited

U.S. PATENT DOCUMENTS

| | | | | |
|---|---|---|---|---|
| 3,961,948 | A | 6/1976 | Saeva | |
| 4,413,266 | A * | 11/1983 | Aviram et al. | 346/21 |
| 5,570,451 | A * | 10/1996 | Sakaizawa et al. | 399/2 |
| 5,790,915 | A * | 8/1998 | Arcaro et al. | 399/2 |
| 5,943,067 | A | 8/1999 | Kong | |
| 6,000,870 | A | 12/1999 | Koga | |
| 6,147,777 | A * | 11/2000 | Jung | 358/473 |
| 6,293,668 | B1 | 9/2001 | Kubby et al. | |
| 6,424,364 | B2 * | 7/2002 | Gundlach et al. | 347/111 |
| 6,527,384 | B2 * | 3/2003 | Isago | 347/100 |
| 6,582,039 | B2 * | 6/2003 | Johnson et al. | 347/3 |
| 7,483,046 | B2 * | 1/2009 | Lee et al. | 347/172 |
| 2005/0151815 | A1 * | 7/2005 | Kanai et al. | 347/102 |
| 2005/0244742 | A1 | 11/2005 | Iftime et al. | |
| 2005/0244743 | A1 | 11/2005 | Iftime et al. | |
| 2005/0244744 | A1 | 11/2005 | Kazmaier et al. | |
| 2007/0008399 | A1 | 1/2007 | Botten et al. | |
| 2007/0140775 | A1 | 6/2007 | Shrader | |
| 2008/0191136 | A1 | 8/2008 | Shrader et al. | |
| 2008/0310869 | A1 | 12/2008 | Iftime et al. | |
| 2009/0034997 | A1 | 2/2009 | Edwards et al. | |

FOREIGN PATENT DOCUMENTS

| | | |
|---|---|---|
| EP | 1 707 394 A1 | 10/2006 |
| JP | A-2001-334649 | 12/2001 |

OTHER PUBLICATIONS

U.S. Appl. No. 11/873,213 to Iftime filed Oct. 16, 2007.
U.S. Appl. No. 12/206,136 to Iftime filed Sep. 8, 2008.
Office Action issued in Canadian Application No. 2,694,107 dated Dec. 15, 2010.
European Search Report dated May 21, 2010.

* cited by examiner

*Primary Examiner* — Stephen Meier
*Assistant Examiner* — Leonard S Liang
(74) *Attorney, Agent, or Firm* — Oliff & Berridge, PLC

(57) ABSTRACT

A printing system and method combine conventional print and reusable print media functionality in a shared stand-alone system to allow a user flexibility in deciding whether to print a temporary document or an archival permanent document. The system integrates and shares functionality to reduce manufacturing and operating costs, as well as to reduce the device's footprint. Commonality may include a common printhead shuttling mechanism (traversing carriage) and portions of the mechanism for moving paper. Pre-conditioning and printzone conditioning stations may also be shared to achieve precondition heating and/or erasing of media sheets prior to printing and maintaining of an elevated temperature during printing. In embodiments, separate feed trays are provided for each media sheet type.

20 Claims, 3 Drawing Sheets

COMBINED INKJET AND PHOTOCHROMIC REUSABLE PAPER PERSONAL PRINTER

BACKGROUND

This disclosure is generally directed to a dual media type printer and method that is capable of printing with both conventional print technologies that apply marking material on conventional media and with inkless and tonerless print technologies on reimageable and reusable transient media, such as photochromic paper.

Conventional printing by xerographic and inkjet print technologies is known. Inkjet printing has a well-established market and uses a relatively low-cost process, where images are formed by ejecting droplets of ink in an image-wise manner onto a substrate. Inkjet printers are widely used in home and business environments, and particularly in home environments due to the low cost of inkjet printers. Inkjet printers generally allow for producing high quality images, ranging from black-and-white text to photographic color images, on a wide range of substrates such as standard office paper, transparencies, and photographic paper.

However, despite the low printer costs, the cost of replacement inkjet cartridges can be high, and sometimes higher than the cost of the printer itself over the life of the machine. These cartridges must be replaced frequently, and thus replacement costs of the ink cartridges are a primary consumer complaint relating to inkjet printing. Reducing ink cartridge replacement costs would thus be a significant enhancement to inkjet printing users.

In addition, many paper documents are promptly discarded after being read. Although paper is relatively inexpensive, the quantity of discarded paper documents is enormous and the disposal of these discarded paper documents raises significant cost and environmental issues. Accordingly, there is a continuing desire to provide a new medium that can display a desired image temporarily, and methods for preparing and using such a medium.

To address these problems, a number of transient media approaches have been developed for transient image formation and storage. These media are designed to replace conventional paper for some applications. However, many forms of transient media provide less than desirable results as a paper substitute. For example, alternative technologies with transient images include liquid crystal displays, electrophoretics, and gyricon image media. While these technologies do provide the desired reimageability, they do not provide a document that has the appearance, feel or portability of traditional paper, nor the low cost that allows users to feel comfortable occasionally losing sheets. More recently, transient document media have been developed having a more paper-like form, such as photochromic paper. Photochromic media is typically marked upon using ultraviolet (UV) light and typically erased with light and/or heat. The media or paper is designed so that it may be reused with different images rendered thereon, in order to replace paper printing in some applications.

Imaging techniques employing photochromic materials, that is materials which undergo reversible or irreversible photoinduced color changes, are known. For example, U.S. Pat. No. 3,961,948 discloses an imaging method based upon visible light induced changes in a photochromic imaging layer containing a dispersion of at least one photochromic material in an organic film forming binder. Other known photochromic materials can be found in U.S. Patent Application Publication No. US2005/0244742 filed Apr. 29, 2004; U.S. Patent Application Publication No. US200510244743 filed Apr. 29, 2004; U.S. Patent Application Publication No. US2005/0244744 filed Apr. 29, 2004; U.S. patent application Ser. No. 12/206,136 filed Sep. 8, 2008 and U.S. patent application Ser. No. 12/400,276 filed concurrently herewith, the disclosures of which are incorporated by reference in their entireties.

These and other photochromic (or reimageable) papers are desirable because they can provide imaging media that can be reused many times, to transiently display images and text. For example, applications for photochromic based media include reimageable documents such as, for example, paper versions of electronic documents. Reimageable documents allow information to be kept for as long as the user wants, then the information can be erased and the media can be re-imaged using an imaging system with different information.

Transient document printers have been described, for example, in U.S. Patent Application Publication No. US2008/0310869 to Iftime et al. and U.S. Patent Application Publication No. US2008/0191136 to Shrader et al., the disclosures of which are incorporated by reference in their entireties.

However, transient media systems often suffer from problems not faced by conventional print media, such as paper printed by a laser printer or ink jet printer. Transient media, particularly photochromic paper, has only limited document image life before the image fades or self-erases, typically on the order of several hours to a few days depending on conditions and media used, and may have a degraded appearance when exposed to elevated light or heat conditions once printed. Thus, transient document printers and photochromic papers cannot fully replace conventional printing where archival quality is sometimes needed. Moreover, transient media systems cannot operate with standard papers or standard print technologies. That is, a transient printer will not print on conventional paper because conventional paper does not have the photochromic materials required for image formation. Likewise, a conventional printer cannot print on photochromic paper, without ruining the reusability of the transient media by depositing permanent marking material on the media. Thus, when a consumer wants to use both types of media sheets, a separate stand-alone system for each type of print technology has been used.

SUMMARY

Aspects of the disclosure provide a printing system and method that combines conventional print and reusable print media functionality in a shared stand-alone system. Such a system would allow a user flexibility in deciding whether to print a temporary document or an archival permanent document or combinations thereof.

In exemplary embodiments, the system and method integrate and share as much functionality as possible to reduce manufacturing and operating costs, as well as to reduce the device's footprint.

In accordance with another aspect, a dual media printing system and method feeds media from separate feed trays depending on media type so that both types of media sheets may be provided.

To maintain low cost, aspects of the disclosure use a shuttling mechanism or carriage that moves printheads for both media types with the same mechanism and reuses image path electronics for both media types.

In one aspect of described embodiments, a dual media type printer is provided that shares common functionality, including a common printhead shuttling mechanism (traversing carriage), paper feed path portions and drive mechanism.

In another aspect of the described embodiments, a dual media type printer may also share pre-conditioning and printzone conditioning stations to achieve precondition heating and/or erasing of media sheets prior to and during printing. This is because conventional ink jet printing can also benefit from heating of the paper as a way to promote ink drying.

In accordance with one aspect of the disclosure, a dual media printer for use with conventional media sheets and transient, reusable media sheets, includes: a first media tray configured for housing the conventional media sheets; a second media tray configured for housing the transient, reusable media sheets; a printer output; a feed path connecting each of the first media tray and second media tray with the printer output, the feed path including a common feed path portion; a drive assembly that selectively feeds the conventional media sheets and the transient, reusable media sheets from either the first media tray or the second media tray to the printer output along the feed path in a feed direction; a reciprocating carriage assembly located on the common feed path; a first printhead mounted to the carriage assembly for movement therewith transverse to the feed direction, the first printhead depositing a marking material onto one of the conventional media sheets to form an image thereon; a second printhead mounted to the carriage assembly for movement therewith transverse to the feed direction, the second printhead irradiating a surface of one of the transient, reusable media sheets to form a transient image thereon; and a pre-conditioning station located on the common feed path upstream of the reciprocating carriage assembly, the pre-conditioning station heating at least the transient, reusable media sheets to condition the sheets for printing.

In accordance with another aspect of the disclosure, a dual media printing method for use with conventional media sheets and transient, reusable media sheets using a dual media printer comprises: feeding a media sheet selected from the conventional media sheets and the transient, reusable media sheets onto a common feed path past a pre-conditioning station; conditioning the fed media sheet at the pre-conditioning station by heating to a desired temperature; operating a common reciprocating carriage assembly to form an image on the fed media sheet using one of a first printhead that applies a marking material onto the media sheet when the media sheet is a conventional media sheet and a second printhead that irradiates with UV light a surface of the media sheet when the media sheet is a transient, reusable media sheet; and outputting the media sheet with a formed image thereon.

A further aspect of the described embodiments makes use of a conventional "instant on" heated roll similar to a fuser roll used in electrophotography as the pre-conditioning station to reduce manufacturing costs.

In embodiments of the described embodiments, the dual media type printer may be an ink jet type printhead and a transient media type printhead of a differing type. However, other marking technologies may be used, such as solid ink printers that melt and provide a different ink marking material, or xerographic or electrophotographic imaging systems that apply a toner marking material onto a media sheet.

In embodiments of the described embodiments, the dual media type printer may include a UV printhead, such as an LED printhead, as a transient media type printhead, and a conventional printhead that applies a marking material, such as ink or toner marking materials, onto a media sheet as a differing type of printhead. However, other inkless and tonerless print technologies can be substituted.

In exemplary embodiments, the printzone conditioning station may be an active or a passive platen that controls the temperature of the media sheet during printing.

In exemplary embodiments, for the case of transient media, the preconditioning station heats the print media sheet to a temperature of about 120° or more, such as in the range of about 120° to about 160° C., for erasure of any residual images, and the printzone conditioning station maintains a temperature of the media sheet above ambient during printing, such as at about 70° C.

In exemplary embodiments, the pre-conditioning station may be in the form of one or more heated platens or strip heaters provided above and/or below the print media.

In exemplary embodiments, the media sheets may be driven by a common drive mechanism in the form of a drive roll, pinch roll or vacuum hold-down belt.

EMBODIMENTS

Figure 1:
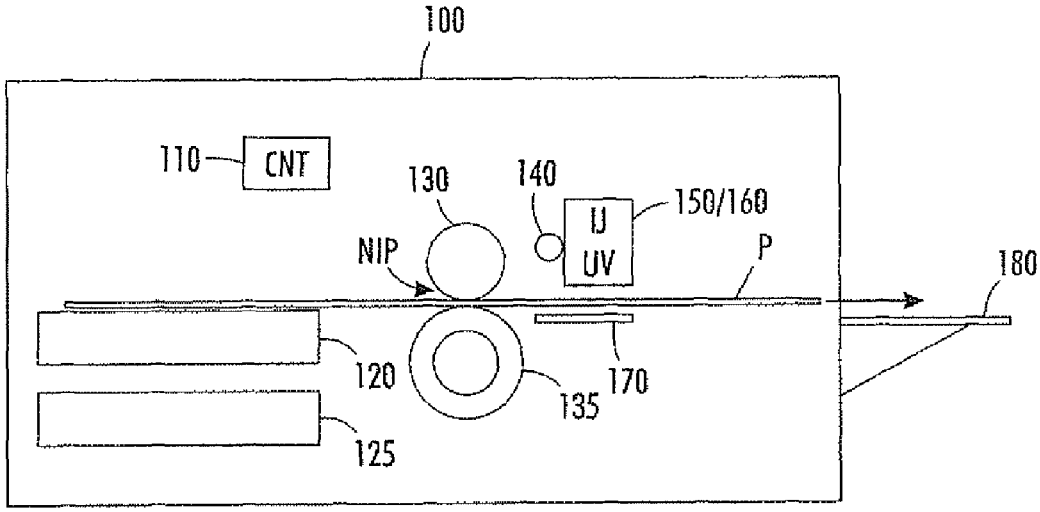
FIGS. 1-2 are representative illustrations of a dual media type printer in accordance with a first embodiment that combines conventional print functionality with transient reusable print functionality using a common shared platform and components, with FIG. 1 showing a paper path for conventional media and FIG. 2 showing a paper path for transient media.
Figure 2:
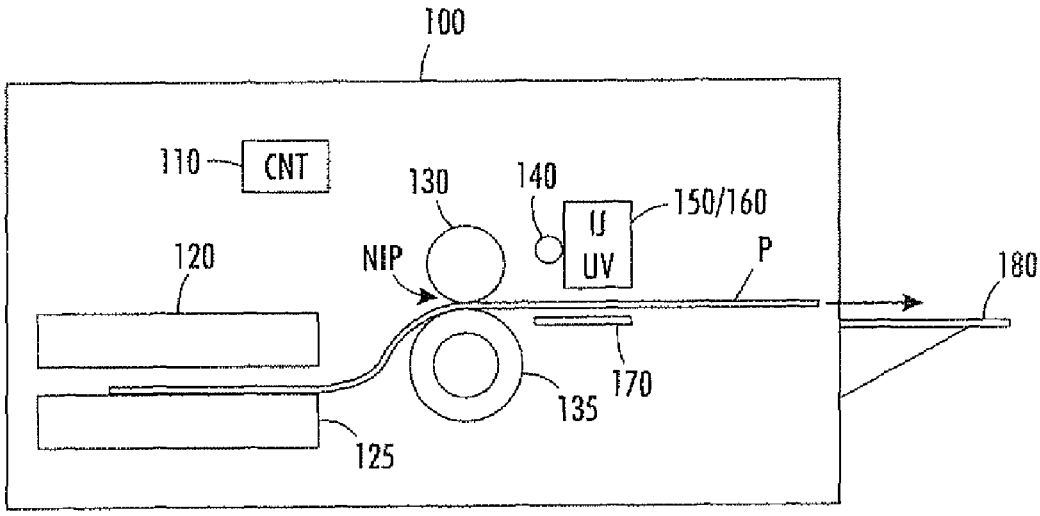

A first embodiment of the disclosure will be described with reference to FIGS. 1-3. A dual media printer 100 is provided with a housing that combines conventional print functionality with transient reusable print functionality using a common shared platform and components. The printer includes a print controller 110 that controls receipt of an input image file and printing of the image file by the printer. A first type media tray 120 houses media sheets of a first type, such as conventional inkjet paper sheets. A second media tray 125 houses sheets of a second, different type, such as transient media sheets that are erasable and reusable, such as photochromic paper. A feed path P leads from each tray and feeds media sheets from the respective trays to a common feed path region where the media sheet passes several print components on its way to an output tray 180. FIG. 1 shows feeding of a media sheet from the first tray 120 to the common feed path region and FIG. 2 shows feeding of a media sheet from the second tray 125 to the common feed path region.

In this embodiment, a drive mechanism is formed by the combination of a drive roll 130 and a heated roll 135 that form a nip region therebetween. The drive mechanism advances the media sheet to a downstream common printhead shuttling mechanism in the form of a traversing carriage assembly 140 that contains a printhead for each of two different print technologies. In this exemplary embodiment, a first printhead is an inkjet printhead 150 that dispenses droplets of ink to form an image and a second printhead is a transient media writing device, such as a UV printhead 160 formed of a plurality of LEDs, that emit UV light that reacts with transient media sheets, such as photochromic paper, to form a temporary image thereon. The heated roll 135 also serves as a preconditioning station that conditions the media sheet prior to printing.

Pre-conditioning station 135 is particularly useful to pre-condition transient media sheets that may have previously been used and contain a pre-existing image thereon. The pre-conditioning station 135 applies heat at a predetermined temperature for a given dwell time sufficient to erase the previous image from the media sheet, allowing the sheet to be reused and formed with a new image. Although the predetermined temperature may differ depending on the particular type of media sheet used, when photochromic paper is used as the media sheet, the temperature is generally in the range of about 120° or more, such as about 120° C. to about 160° C. An increase in processing speed or transport rate may require higher temperatures to achieve a desired heating temperature to the media sheet. With a process speed of about 5 pages per minute, a temperature of approximately 160° has been found satisfactory.

In this embodiment, a conventional "instant-on" fuser roll found in low-end laser printers has been found satisfactory as a low-cost and efficient mechanism to achieve erase heating. An instant-on fuser roll has an internal quartz heater at the center of the roll to rapidly heat the outer surface of the fuser roll. However, other conventional and subsequently developed heating structures can be substituted.

The drive roll 130 incrementally advances the media sheet by a print swath spacing between print swaths to locate the new region to be imaged under the traversing carriage assembly 140. In order to have the media sheet dwell at a desired elevated temperature needed for erasure, and given that the drive speed is preferably rapid during paper advance to improve throughput, the sheet media should either be wrapped over a portion of the heated fuser roll 135 forming the pre-conditioning station prior to the relatively narrow nip, or fuser roll 135 should have a nip that is as long or longer than the amount that the media sheet is advanced. Because the transient media sheet benefits most from the pre-conditioning, one way to achieve this is to have the transient media sheets fed from the lower tray 125. The feed path for this media can be made to pass across an arc of the heated roll 135 to increase the contact area, and thus improve thermal transfer and increase dwell time, as shown in FIG. 2. Alternatively, other pre-conditioning station components could be used instead of the fuser roll, such as platen heaters provided above and/or below the media sheet as discussed in another embodiment. Other heating methods can also be used.

Figure 3:
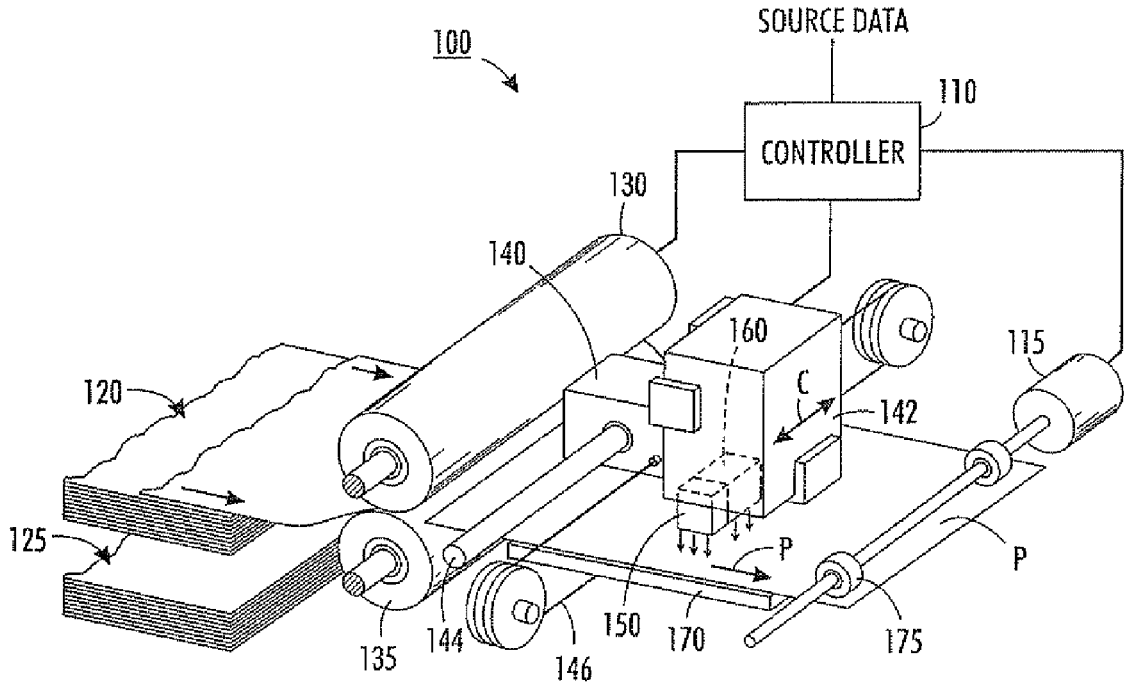
FIG. 3 is a partial perspective view of main drive and print components within the printer housing of FIGS. 1-2.

As better shown in FIG. 3, the two printheads 150, 160 can be mounted to the same carriage assembly 140 and can beneficially be arranged side-by-side in a carriage movement direction C that is transverse to the feed path direction P of the sheet media. Image path electronics within controller 110 can then control imaging by each printhead from source data as the carriage assembly 140 traverses back and forth across the media sheet as is known in the art.

Back and forth shuttling can be achieved, for example, by carriage assembly 140 containing a cartridge housing 142 that fixedly receives the inkjet printhead 150 and UV printhead 160. Housing 142 is laterally guided by guide bar 144 and moved by a drive mechanism 146, such as a cable driven by a motor (unshown) as is known in the art, or driven by a lead screw (unshown).

Typically, inkjet printheads have a maintenance station that maintains operation of the various inkjet nozzles. Maintenance stations usually include an inkjet printhead cap that covers the nozzles during non-use to prevent excessive drying out of ink. These stations are often located at a park position of the carriage assembly near one end of travel and out of the printzone region opposing the media sheet. However, because operation of the UV printhead 160 during non-use of the inkjet printhead 150 will prevent return to the park position for extended periods of time, it may be desirable to add a positionable maintenance cap directly to the inkjet printhead. This will allow capping of the inkjet printhead 150 even during periods of travel. Alternatively, the inkjet and/or UV printheads may be selectively decoupled from the carriage assembly when not in use so that only one printhead travels with the carriage assembly at one time. For example, with this, the inkjet printhead could remain at the maintenance station during operation of the WV printhead.

Transport of the media sheet past the printheads 150, 160 and to a printer output, such as output tray 180, may be assisted by additional drive mechanisms, such as pinch roll 175 driven by motor 115 downstream of the printheads.

In embodiments, a printzone region traversed by the carriage assembly 140 and printheads 150, 160 includes a printzone conditioning station 170 that maintains the media sheet at a desired elevated temperature conducive to writing. This is particularly beneficial for transient media that rely on combinations of UV exposure and heat for imaging, such as certain photochromic paper formulations described in co-pending U.S. patent application Ser. No. 12/400,276 filed concurrently herewith and incorporated by reference in its entirety.

In exemplary embodiments, the temperature is maintained to be above ambient, such as in a range of 40-90° C., or about 70° C. In exemplary embodiments, the printzone conditioning station 170 may be active or passive. If active, the printzone conditioning station 170 may be formed of a heated platen that is located under the printheads 150, 160 and extends generally the width of the printheads 150/160 in the feed direction as shown, and may form portions of the output tray 180 itself. The conditioning station 170 when active should not extend beyond the printzone. If passive, the printzone conditioning station 170 may be formed of an insulated platen with a low thermal conduction that controls the cooling rate of the media sheet so that it maintains a desired elevated temperature during printing thereon. Because aqueous ink printing systems such as inkjet printing also have been shown to have improved image quality when the media has been heated, the printzone conditioning station 170 is another shared component that is used by either imaging technology to allow the media sheet to be controlled at a desired temperature to attain necessary quality and consistency in the imaging process.

With this dual media printer 100, a user is able to readily print on either of two media sheet types using two different imaging technologies. In exemplary embodiments, the type of media sheet used may be user selected by setting of a desired operation mode or specified as part of the input image file in which case the selection may be automated based on specific image content. When a temporary transient document is desired, such as for reviewing of a draft, the user selects a transient document mode where the printer 100 feeds a media sheet from the transient media tray 125 and activates the pre-conditioning station 135 to heat (FIG. 2). The media sheet is then advanced through the heated nip where any pre-existing image on the transient media sheet is erased. The heated media sheet is then advanced to a printzone where the media sheet is written upon with the UV LED printhead 160 shuttled on the common carriage assembly to form an image thereon based on a received input image file. The printzone conditioning station 170 maintains the desired elevated temperature of the media sheet during printing. Similarly, when an archival document is desired, the user selects a archival document mode where the printer 100 feeds a media sheet from the conventional media tray 120 through the nip and into the printzone, where it is written upon with the inkjet printhead 150 by shuttling of the common carriage assembly (FIG. 1). As with the transient document, one or both of the pre-conditioning station 135 and printzone conditioning station 170 may be activated to maintain the media sheet at an elevated temperature during printing to improve image quality. To ensure proper operation, a sensor may be provided that detects loading of proper media sheet type in each tray as described in U.S. Pat. No. 7,935,463 filed concurrently herewith and incorporated by reference in its entirety. Alternatively, because transient media sheet, such as photochromic paper, are often of a non-white color due to the coating process, they can also be distinguished by color.

Figure 4:
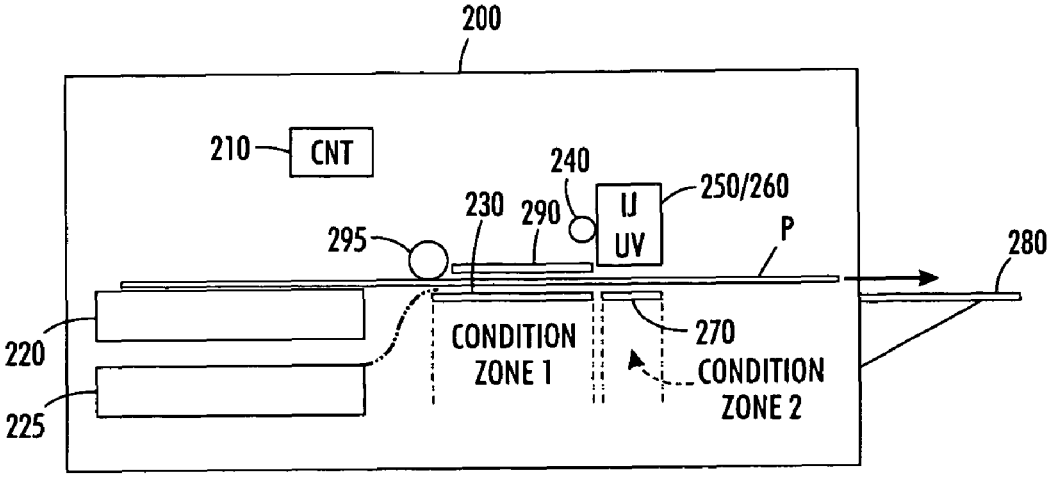
FIG. 4 is a representative illustration of a dual media type printer in accordance with a second embodiment, in which upper and lower heating platens are used in place of a heated roll and a pinch-roll type drive mechanism is used.

The second embodiment of FIG. 4 is similar to that of FIGS. 1-2, and provides a dual media type printer 200 having a common housing containing a controller 210, first media tray 220 that houses a first-type media sheet (such as conventional paper), second media tray 225 that houses a second-type media sheet (such as transient photochromic media), reciprocating carriage assembly 240 having an inkjet printhead 250 and UV printhead 260 mounted for movement thereon, printzone conditioning station 270, and output tray 280. The second embodiment differs from FIGS. 1-2 by using a pinch-roll type drive mechanism 295 instead of a drive roll, and upper and lower heated platens 230, 290 as the pre-conditioning station instead of a fuser roll. Pinch-roll type drive mechanisms are well known and can be configured such as that shown as element 175 in FIG. 3 with the pinch rolls located near outboard sides of the media and driven by a motor as in FIG. 3. The use of upper and lower heated platens 230, 290 may provide reduced dwell time and can result in increased media feed rates due to the increased surface area opposed to the media sheet during feeding. This increased surface area can improve heating efficiencies allowing the media sheet to reach desired erase or pre-conditioning temperature conditions more readily. In this embodiment, a first zone achieves pre-conditioning of the media sheet prior to imaging, and a second zone achieves conditioning of the media sheet during printing as shown.

Figure 5:
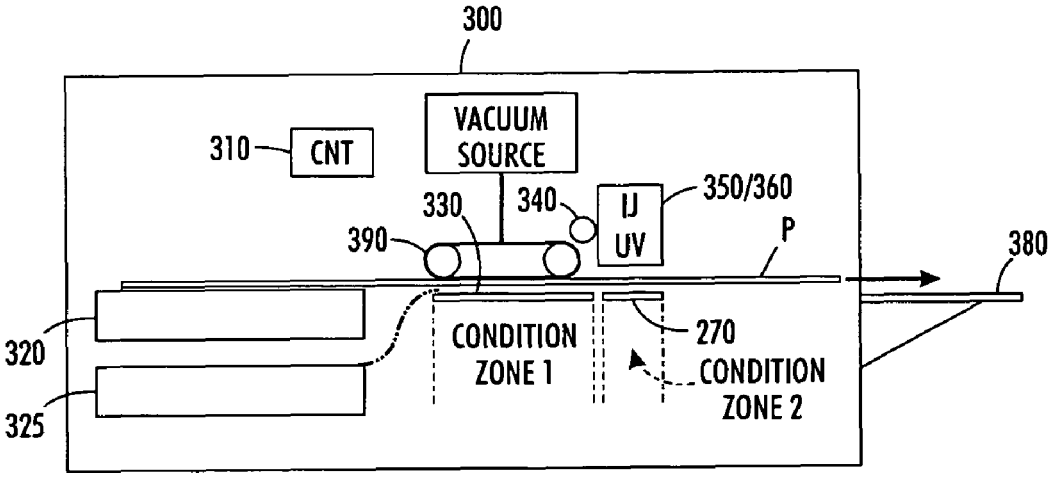
FIG. 5 is a representative illustration of a dual media type printer in accordance with a third embodiment, in which a lower heating platen is used with a vacuum hold-down drive mechanism.

The third embodiment of FIG. 5 is similar to that of FIG. 4, and provides a dual media type printer 300 having a common housing containing a controller 310, first media tray 320 that houses a first-type media sheet (such as conventional paper), second media tray 325 that houses a second-type media sheet (such as transient photochromic media), reciprocating carriage assembly 340 having an inkjet printhead 350 and UV printhead 360 mounted for movement thereon, printzone conditioning station 370, and output tray 380. The third embodiment also uses a heated lower platen 330 as the pre-conditioning station instead of a heated roll. However, to provide drive force and to improve thermal efficiency, this embodiment uses a vacuum hold-down 390. Vacuum hold-down 390 serves to advance the media sheet along the feed path while also urging the media sheet against the heated lower platen 330 to improve heating efficiency, allowing the media sheet to reach desired erase or pre-conditioning temperature conditions more readily. As in the FIG. 4 embodiment, this embodiment provides a first zone that achieves pre-conditioning of the media sheet prior to imaging, and a second zone that achieves conditioning of the media sheet during printing as shown.

Although exemplary embodiments show use of a traversing carriage and shuttled first and second printheads, alternative embodiments may use full or partial-width printbars that are fixed in location. In this regard, to minimize the printer footprint and paper feed path, the first and second printheads may be located closely adjacent one another.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A dual media printer for use with conventional media sheets and transient, reusable media sheets, comprising:

a first media tray configured for housing the conventional media sheets;

a second media tray configured for housing the transient, reusable media sheets;

a printer output;

a feed path connecting each of the first media tray and second media tray with the printer output, the feed path including a common feed path portion;

a drive assembly that selectively feeds the conventional media sheets and the transient, reusable media sheets from either the first media tray or the second media tray to the printer output along the feed path in a feed direction;

a reciprocating carriage assembly located on the common feed path;

a first printhead mounted to the carriage assembly for movement therewith transverse to the feed direction, the first printhead depositing a marking material onto one of the conventional media sheets to form an image thereon;

a second printhead mounted to the carriage assembly for movement therewith transverse to the feed direction, the second printhead irradiating a surface of one of the transient, reusable media sheets to form a transient image thereon; and a pre-conditioning station located on the common feed path upstream of the reciprocating carriage assembly, the pre-conditioning station heating at least the transient, reusable media sheets to condition the sheets for printing.

2. The dual media printer according to claim 1, wherein the pre-conditioning station is heated to a temperature for a dwell time sufficient to erase previous images on the transient media sheet prior to printing by the second printhead.

3. The dual media printer according to claim 2, wherein the temperature of the pre-conditioning station is between about 120° to about 160° C.

4. The dual media printer according to claim 2, wherein the pre-conditioning station is an instant on heated roll.

5. The dual media printer according to claim 1, further comprising a printzone conditioning station located on the common feed path under the reciprocating carriage assembly, the printzone conditioning station maintaining an elevated temperature of at least the transient, reusable media sheets during printing of above ambient.

6. The dual media printer according to claim 5, wherein for transient sheets, the printzone conditioning station maintains an elevated temperature during printing in the range of 40-90° C.

7. The dual media printer according to claim 5, wherein the printzone conditioning station actively controls at a temperature above ambient one the conventional media sheets and/or the transient, reusable media sheets.

8. The dual media printer according to claim 5, wherein the printzone conditioning station passively maintains the elevated temperature imposed by the pre-printing conditioning station by insulating fed ones of the conventional media sheets or transient, reusable media sheets from excessive heat loss as the fed ones are held stationary under the carriage mechanism during printhead writing.

9. The dual media printer according to claim 1, wherein the feed path is configured to provide a greater pre-conditioning station contact area to transient, reusable media sheets than to conventional media sheets.

10. The dual media printer according to claim 9, wherein the pre-conditioning station is a heated roll having a circumference and the greater contact area is achieved by wrapping the transient, reusable media sheet around a different fraction of the circumference.

11. A dual media printing method for use with conventional media sheets and transient, reusable media sheets using a dual media printer, the printer having a first media tray housing the conventional media sheets, a second media tray housing the transient, reusable media sheets, a drive assembly, and a common feed path, the method comprising:

feeding a media sheet via the common feed path, the drive assembly selecting the media sheet from the conventional media sheets and the transient, reusable media sheets onto the common feed path past a pre-conditioning station;

conditioning the fed media sheet at the pre-conditioning station by heating to a desired temperature;

operating a common reciprocating carriage assembly to form an image on the fed media sheet using one of a first printhead that applies a marking material onto the media sheet when the media sheet is a conventional media sheet and a second printhead that irradiates a surface of the media sheet when the media sheet is a transient, reusable media sheet; and outputting the media sheet with a formed image thereon.

12. The method according to claim 11, wherein the pre-conditioning station is heated to a temperature for a dwell time sufficient to erase previous images on the media sheet prior to printing by the second printhead when the media sheet is a transient, reusable media sheet.

13. The method according to claim 12, wherein the temperature is between about 120° to about 160° C.

14. The method according to claim 12, wherein the pre-printing conditioning station is an instant on heated roll.

15. The method according to claim 11, further comprising maintaining an elevated temperature of the media sheet during printing of above ambient at a printzone conditioning station located on the common feed path under the reciprocating carriage assembly.

16. The method according to claim 15, wherein for transient media, the elevated temperature of the media sheet during printing is in the range of 40-90° C.

17. The method according to claim 15, wherein the elevated temperature in the printzone is achieved by active heat from the pre-conditioning station and passive insulation of the media sheet from heat loss as the sheet is held stationary under the carriage mechanism during printhead writing.

18. The method according to claim 11, further comprising providing a greater contact area of the pre-conditioning station to transient, reusable media sheets than to conventional media sheets during the feeding.

19. The method according to claim 18, wherein the pre-conditioning station is a heated roll having a circumference and the greater contact area is achieved by wrapping the transient, reusable media sheet around a different fraction of the circumference.

20. A dual media printer for use with conventional media sheets and transient, reusable media sheets, comprising:

a first media tray configured for housing the conventional media sheets;

a second media tray configured for housing the transient, reusable media sheets;

a printer output;

a feed path connecting each of the first media tray and second media tray with the output, the feed path including a common feed path portion;

a drive assembly that selectively feeds the conventional media sheets and the transient, reusable media sheets from either the first media tray or the second media tray to the output along the feed path in a feed direction;

a reciprocating carriage assembly located on the common feed path;

an inkjet printhead mounted to the carriage assembly for movement therewith transverse to the feed direction, the inkjet printhead depositing a marking material onto one of the conventional media sheets to form an image thereon;

a UV printhead mounted to the carriage assembly for movement therewith transverse to the feed direction, the UV printhead irradiating a surface of one of the transient, reusable media sheets to form a transient image thereon;

a pre-conditioning station located on the common feed path upstream of the reciprocating carriage assembly, the pre-conditioning station heating at least fed transient, reusable media sheets to a temperature between about 120° to about 160° C. for a dwell time sufficient to erase a previous image on the transient, reusable media sheet prior to printing by the UV printhead; and a printzone conditioning station located on the common feed path under the reciprocating carriage assembly, the printzone conditioning station maintaining an elevated temperature of fed ones of the conventional media sheets or transient, reusable media sheets during printing of above ambient.

* * * * *